United States Patent [19]

Stern et al.

[11] Patent Number: 4,806,886

[45] Date of Patent: Feb. 21, 1989

[54] MICROSTRIP RESONANCE ISOLATOR

[75] Inventors: Richard A. Stern, Allenwood; Richard W. Babbitt, Fairhaven, both of N.J.

[73] Assignee: The United States of America as represented by the Secretary of the Army, Washington, D.C.

[21] Appl. No.: 162,723

[22] Filed: Mar. 1, 1988

[51] Int. Cl.[4] ..... H01P 1/365

[52] U.S. Cl. ..... 333/24.2; 333/26

[58] Field of Search ..... 333/24.1, 24.2

[56] References Cited

U.S. PATENT DOCUMENTS

| | | | |
|---|---|---|---|
| 4,459,567 | 7/1984 | Stern et al. | 333/24.2 |
| 4,745,377 | 5/1988 | Stern et al. | 333/26 |
| 4,749,966 | 6/1988 | Stern et al. | 333/1.1 |

OTHER PUBLICATIONS

Microwave Ferrites by P. J. B. Clarricoats, 1961, John Wiley & Sons, Inc., N.Y., pp. 213, 214 & 228–230.

*Primary Examiner*—Paul Gensler

*Attorney, Agent, or Firm*—Sheldon Kanars; Robert A. Maikis

[57] ABSTRACT

A microstrip resonance isolator is provided comprising a dielectric waveguide element which is mounted on the top surface of a length of microstrip transmission line dielectric substrate having an electrically conductive ground plane on the bottom surface of the substrate. The waveguide element has a rectangular rod-shaped central section and two oppositely-inclined ramp-shaped sections at the ends of the central section. The dielectric constant of the waveguide element is substantially more than the dielectric constant of the microstrip transmission substrate. A microstrip conductor is provided on the top surface of the substrate from one end thereof to the other end thereof and passes over the top surface of the dielectric waveguide element. A thin, rectangular substrate of hexagonal, grain-oriented ferrite material is mounted on one side of the waveguide element between the ramp-shaped end sections. The ferrite substrate material is given a predetermined unidirectional magnetic orientation in a direction which is parallel to the plane of the side of the waveguide element on which the ferrite substrate is mounted and is substantially perpendicular to the plane of the microstrip dielectric substrate top surface, so that the ferrite substrate and the dielectric waveguide element cooperate to form a dielectric waveguide resonance isolator and the ends of the microstrip conductor act as the terminals of the microstrip isolator.

5 Claims, 1 Drawing Sheet

FIG. 1
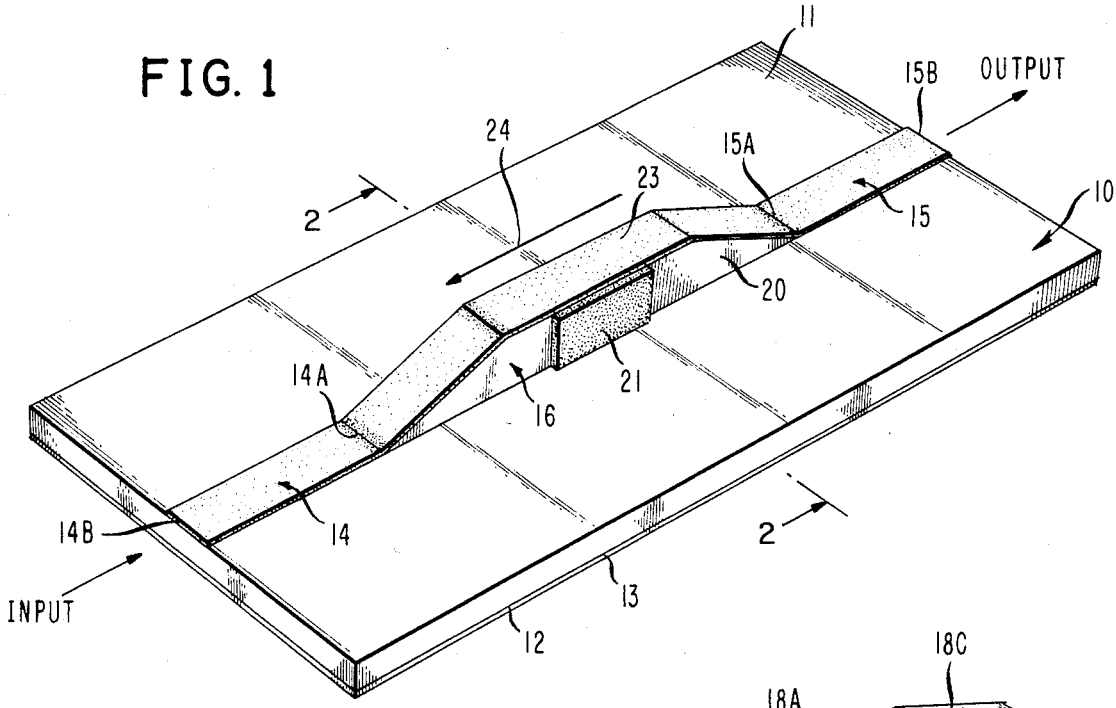
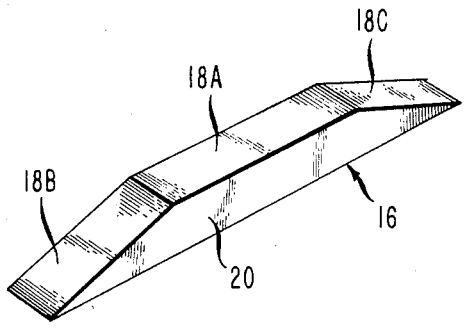
FIG. 3
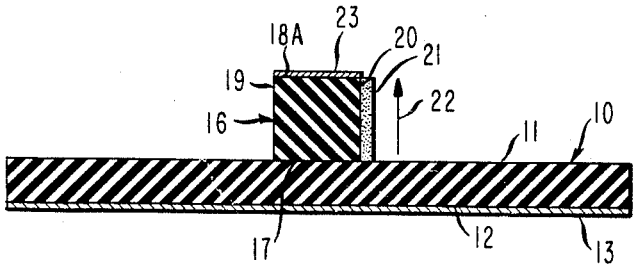
FIG. 2
FIG. 4
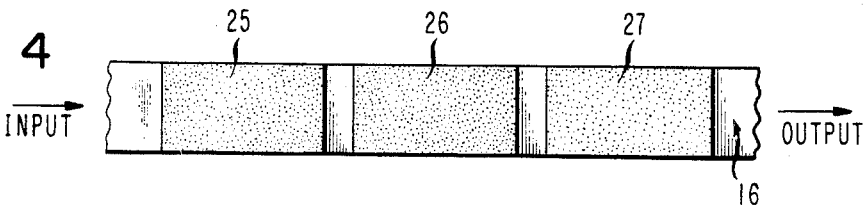

MICROSTRIP RESONANCE ISOLATOR

STATEMENT OF GOVERNMENT RIGHTS

The invention described herein may be manufactured, used and licensed by or for the Government for governmental purposes without the payment to us of any royalties thereon.

BACKGROUND OF THE INVENTION

1. Field of the Invention

This invention relates to microstrip transmission lines and microstrip transmission line components operating in the millimeter wave region of the frequency spectrum and more particularly to a microstrip resonance isolator for use with such microstrip transmission lines and microstrip components.

2. Description of the Prior Art

Isolators are essentially two port, non-reciprocal attenuation devices which are used in RF transmission line applications, such as in the millimeter wave region of the frequency spectrum, for example, to provide a low loss transmission of electromagnetic wave energy from the input port to the output port but only a very limited or attenuated transmission of energy from the output port to the input port. They are often used in applications, such as in radar equipment, for example, to protect signal sources from other undesirable or damaging signal sources. Resonance isolators which utilize a thin substrate of a hexagonal, grain-oriented ferrite material have been developed which rely on the absorption of energy that occurs at ferromagnetic resonance. A ferrite resonance isolator of this type is shown and described in U.S. Pat. No. 4,459,567 which was issued July 10, 1984 to the applicants of the present application and was assigned to the assignee of the present application.

Planar type circuitry using microstrip is widely used in millimeter wave frequency applications because it permits the design of equipment having extremely small size and low weight which is desirable for many items of military and commercial equipment, such as the aforementioned radar equipment, for example. Unfortunately, resonance isolators utilizing hexagonal ferrite materials which are suitable for use in the millimeter wave region of the frequency spectrum are not available for microstrip transmission line applications at the present time. The resonance isolator shown and described in said U.S. Pat. No. 4,459,567 is designed in the solid, dielectric waveguide medium. Although circulators are often employed in millimeter wave microstrip applications as isolator devices, the circulators are more lossy and bulky than ferrite resonance isolators. Additionally, the circulators often require biasing magnets for operation which increases the size and weight of the equipment in which the circulator is installed. Accordingly, a need exists for a resonance isolator which will operate in microstrip applications in the millimeter wave region of the frequency spectrum.

SUMMARY OF THE INVENTION

It is an object of this invention to provide a microstrip resonance isolator which is suitable for use in the millimeter wave region of the frequency spectrum.

It is a further object of this invention to provide a millimeter wave microstrip resonance isolator of extremely small size and low weight which can be both fabricated and installed in microstrip transmission line applications relatively easily and inexpensively.

It is still further object of this invention to provide a microstrip resonance isolator which is especially suited for use in radar applications designed in the microstrip transmission line medium.

Briefly, the microstrip resonance isolator of the invention comprises a length of microstrip transmission line dielectric substrate having top and bottom planar surfaces. An electrically conductive ground plane is mounted on the bottom surface of the substrate. First and second lengths of electrically conductive microstrip conductor are mounted on the top surface of the substrate in longitudinal alignment with each other and spaced a distance apart by a longitudinally-extending gap so that one end of each of the lengths of microstrip conductor defines a different end of the gap. A dielectric waveguide element having a rectangular cross-section, two planar sides and a length substantially the same as the length of the gap is mounted on the dielectric substrate in the gap in longitudinal alignment with the lengths of microstrip conductor. The waveguide element has a planar bottom surface abutting the top surface of the substrate and a top surface having a central planar section and two mutually oppositely-inclined ramp sections at the ends of the central section. The dielectric constant of the waveguide element is substantially greater than the dielectric constant of the dielectric substrate. A third length of microstrip conductor is mounted on the top surface of the waveguide element and extends between the ends of the gap. The third length of microstrip conductor has the ends thereof electrically connected to the one end of the first and second lengths of microstrip conductor so that the third length of microstrip conductor is serially interconnected with the first and second lengths of microstrip conductor and the other ends of the first and second lengths of microstrip conductor form the input and output terminals of the microstrip resonance isolator. Finally, a thin, rectangular substrate of hexagonal, grain-oriented ferrite material is mounted on one of the sides of the dielectric waveguide element and extends along a portion of the length of the waveguide element top surface central section. The ferrite material has a unidirectional magnetic orientation in a direction which is parallel to the plane of the one side of the waveguide element and substantially perpendicular to the plane of the microstrip dielectric substrate top surface and which provides low loss transmission of electromagnetic wave energy travelling from the input terminal of the isolator to the output terminal thereof and high attenuation of such energy travelling from the output terminal of the isolator to the input terminal thereof.

The nature of the invention and other objects and additional advantages thereof will be more readily understood by those skilled in the art after consideration of the following detailed description taken in conjunction with the accompanying drawings.

BRIEF DESCRIPTION OF THE DRAWINGS

In the drawings:

FIG. 1 is a perspective view of the microstrip resonance isolator of the invention;

FIG. 2 is a full sectional view of the microstrip resonance isolator taken along the line 2—2 of FIG. 1;

FIG. 3 is a perspective view of the dielectric waveguide element shown in FIGS. 1 and 2; and FIG. 4 is a side elevation view of the dielectric waveguide element of FIGS. 1–3 with a series of ferrite substrates mounted thereon to form a broadband resonance isolator, the view being foreshortened for convenience of illustration.

DESCRIPTION OF THE PREFERRED EMBODIMENT OF THE INVENTION

Referring now to FIGS. 1 and 2 of the drawings, there is shown a microstrip resonance isolator constructed in accordance with the teachings of the present invention comprising a length of microstrip transmission line dielectric substrate, indicated generally as 10, having a planar top surface 11 and a planar bottom surface 12. The substrate 10 may, for example, comprise a section of conventional microstrip transmission line substrate which is approximately 0.010 inch thick and which is fabricated of duroid or other similar dielectric material having a relatively low dielectric constant. An electrically conductive ground plane 13 which should be fabricated of a good conducting material, such as copper or silver, for example, is mounted on the bottom surface 12 of the substrate and covers that entire surface.

First and second lengths of electrically conductive microstrip conductor, indicated generally as 14 and 15, respectively, are mounted on the top surface 11 of the substrate in longitudinal alignment with each other and are spaced a distance apart by a longitudinally-extending gap. As will be seen in FIG. 1, the first and second lengths of microstrip conductor 14, 15 are longitudinally aligned with each other and with the labelled "Input" and "Output" arrows. One end 14A of the first conductor length 14 defines one end of the longitudinally-extending gap and one end 15A of the second length of conductor 15 defines the other end of the gap. The microstrip conductor lengths 14 and 15 should be fabricated of a good electrical conductor, such as copper or silver, for example.

A dielectric waveguide element, indicated generally as 16, is mounted on the top surface 11 of the dielectric substrate 10 and is longitudinally aligned with the first and second lengths of microstrip conductor 14, 15. As seen in FIGS. 2 and 3 of the drawings, the waveguide element has a rectangular cross-section at every point along its length. Accordingly, it has a planar bottom surface 17 which abuts the top surface 11 of the substrate, a top surface, and two planar sides 19 and 20. As seen in FIG. 1, the waveguide element 16 has a length which is substantially the same as the length of the gap formed by the ends 14A and 15A of the first and second lengths of microstrip conductor. As shown in FIG. 3, the top surface of the waveguide element 16 has a central planar section 18A and two mutually oppositely-inclined ramp sections 18B, 18C at the ends of the central section. The dielectric waveguide element 16 should be fabricated of a material having a dielectric constant which is substantially greater than the dielectric constant of the dielectric substrate 10 for reasons which will be explained hereinafter. For example, if the substrate 10 is fabricated of duroid which has a dielectric constant of 2.2, the dielectric waveguide element may be fabricated of magnesium titanate which has a dielectric constant of 13. A thin rectangular substrate 21 of hexagonal, grain-oriented ferrite material is mounted on one side 20 of the dielectric waveguide element 16. The ferrite substrate 21 extends along only a portion of the length of the wavguide element top surface central section 18A and may have a height which is substantially the same as the height of the dielectric waveguide element top surface central section 18A above the microstrip dielectric substrate top surface 11. The ferrite substrate 21 may have a thickness of about 0.005 inch and may extend along a portion of the length of the waveguide element top surface central section 18A which ranges from about 0.050 inch to 0.300 inch, depending upon the composition of the particular ferrite material used. A low electrical loss epoxy type adhesive, such as Scotch-Weld Structural Adhesive which is marketed by the 3M Company of St. Paul, Minn., for example, may be employed to bond the ferrite substrate 21 to the side 20 of the dielectric waveguide element.

The thin, rectangular substrate 21 is fabricated of a hexagonal ferrite material, such as barium oxide substituted NiCo ferrite, for example. Hexagonal ferrite materials differ from conventional microwave and millimeter wave ferrite materials in that hexagonal ferrite materials are grain-oriented, uniaxial materials which have high anisotropy magnetic fields whereas conventional ferrites have many thousands of randomly-oriented crystallites which must be aligned and kept in alignment by an external magnetic biasing force, such as a magnet, for example. Consequently, if a hexagonal ferrite material is given a particular unidirectional magnetic orientation, it will retain that magnetic orientation without the application of any external magnetic biasing force.

In accordance with the invention, after the hexagonal ferrite substrate 21 is mounted on the side 20 of the dielectric waveguide element 16, the hexagonal ferrite material is caused to assume a particular unidirectional magnetic orientation by a temporarily applied external magnetic biasing force, such as an electromagnet, for example. The direction of the unidirectional magnetic orientation of the ferrite material is shown schematically as the arrow 22 in FIG. 2 of the drawings. The direction of magnetic orientation should be parallel to the plane of the side 20 of the dielectric waveguide element 16 on which the ferrite substrate 21 is mounted. The direction of magnetic orientation should also be substantially perpendicular to the plane of the top surface 11 of the microstrip dielectric substrate 10 and should be such as will provide a low loss transmission of electromagnetic wave energy travelling from the Input of the isolator to the Output of the isolator and a high attenuation of energy travelling from the Output of the isolator to the Input of the isolator.

A third length of electrically conductive microstrip conductor 23 is mounted on the top surface of the dielectric waveguide element 16 and extends between the ends of the gap defined by the end 14A of microstrip conductor 14 and the end 15A of microstrip conductor 15. The ends of the third length of microstrip conductor 23 are electrically connected by means, such as soldering, for example, not illustrated, to the ends 14A and 15A of the microstrip conductor lengths 14 and 15, respectively. Accordingly, the third length of microstrip conductor 23 is serially interconnected with the first length 14 and the second length 15 of microstrip conductor so that the other ends 14B and 15B of the first and second lengths of conductor, respectively, may function as the input and output terminals of the microstrip resonance isolator of the invention. In practice, each of the first, second and third lengths of microstrip conductor may comprise a section of a single integral length of microstrip conductor which extends continuously from the Input terminal 14B of the isolator to the Output terminal 15B of the isolator or each of the first, second and third lengths of microstrip conductor may comprise a separate length of microstrip conductor, as illustrated in the drawings.

In operation, when a millimeter wavelength signal is applied to the Input terminal 14B of the isolator, it is transmitted along the first length 14 of microstrip conductor since that length in conjunction with the ground plane 13 and the dielectric substrate 10 form a short section of conventional microstrip transmission line. At end 14A of the microstrip conductor length 14, the applied signal passes along a microstrip transmission line which is formed by the portion of microstrip conductor length 23 which lies on the upwardly sloping ramp section 18B of the dielectric waveguide element top surface and the ground plane and the dielectric substrate 10. However, as the signal progresses up the sloping section it begins to become transmitted by the solid dielectric waveguide material of the dielectric waveguide element 16 because the dielectric constant of the dielectric waveguide element is substantially greater than the dielectric constant of the microstrip substrate 10. When the signal enters that portion of microstrip conductor length 23 which lies on the central section 18A of the dielectric waveguide element top surface, the signal becomes completely captured by the dielectric waveguide element 16 which acts as a section of a solid dielectric waveguide transmission line. At this point, the hexagonal ferrite substrate 21 which is mounted on the side of the dielectric waveguide element 16 cooperates with that element to form a dielectric waveguide ferrite resonance isolator. The isolator action takes place because of the interaction beween the magnetized ferrite substrate 21 and the RF magnetic field of the millimeter wave which is being propagated through the dielectric waveguide member 16. A detailed explanation of this phenomenon is set forth in said U.S. Pat. No. 4,459,567 and will not be described further here.

If the hexagonal ferrite substrate 21 is premagnetized so that the hexagonal ferrite material of the substrate has a unidirectional magnetic orientation in the direction of the arrow 22 shown in FIG. 2 of the drawings, for example, the millimeter wave energy applied to the Input 14B of the isolator will be transmitted to the Output terminal 15B of the isolator with a very low loss. However, any energy applied in the reverse direction, as represented by the arrow 24 in FIG. 1, will be greatly attenuated or absorbed. If it is desired to enhance the isolation effect, to thereby permit the length of the dielectric waveguide element 16 to be shortened, a second substrate of hexagonal ferrite material, identical to the first substrate 21, may be mounted on the opposite side 19 of the dielectric waveguide element 16 but the magnetic orientation of the second substrate of hexagonal material must have a magnetic orientation which is opposite in direction to the magnetic orientation of the substrate 21.

After the applied millimeter wave signal passes through the portion of the dielectric waveguide element 16 which lies under the central section 18A, it becomes gradually converted from the dielectric waveguide mode of transmission to the microstrip transmission line mode of transmission because of the downwardly sloping ramp section 18C of the top surface of the dielectric waveguide element. By the time the signal passes along the length 15 of microstrip conductor and reaches the Output terminal 15B of the isolator it will again be completely in the microstrip transmission mode.

A modification of the isolator of the invention is shown in FIG. 4 of the drawings. In this arrangement, a longitudinally-extending and longitudinally spaced-apart series of hexagonal, grain-oriented ferrite substrates 25, 26 and 27 are mounted on one side of the dielectric waveguide element 16. The magnetic orientation of the three substrates 25, 26 and 27 would be the same. However, each of the ferrite substrates 25, 26 and 27 would function over different but contiguous frequency bands. This arrangement would permit the isolator to function as a combined broadband isolator.

It is believed apparent that many changes could be made in the construction and described uses of the foregoing microstrip resonance isolator and many seemingly different embodiments of the invention could be constructed without departing from the scope thereof. Although the microstrip resonance isolator has been described with reference to use in the millimeter wave region of the frequency spectrum, it is apparent that the isolator is not limited in use to applications solely in this frequency region. Accordingly, it is intended that all matter contained in the above description or shown in the accompanying drawings, shall be interpreted as illustrative and not in a limiting sense.

What is claimed is:

1. A microstrip resonance isolator comprising a length of microstrip transmission line dielectric substrate having top and bottom planar surfaces;

an electrically conductive ground plane mounted on the bottom surface of said substrate;

first and second lengths of electrically conductive microstrip conductor mounted on the top surface of said substrate in longitudinal alignment with each other and spaced a distance apart by a longitudinally-extending gap so that one end of each of said lengths of microstrip conductor defines a different end of said gap;

a dielectric waveguide element having a rectangular cross-section, two planar sides and a length substantially the same as the length of said gap mounted on said substrate in said gap in longitudinal alignment with said lengths of microstrip conductor, said waveguide element having a planar bottom surface abutting the top surface of said substrate and a top surface having a central planar section and two mutually oppositely-inclined ramp sections at the ends of said central section, the dielectric constant of said waveguide element being substantially greater than the dielectric constant of said substrate;

a third length of electrically conductive microstrip conductor mounted on the top surface of said waveguide element and extending between the ends of said gap, said third length of microstrip conductor having the ends thereof electrically connected to said one end of said first and second lengths of microstrip conductor so that said third length of microstrip conductor is serially interconnected with said first and second lengths of microstrip conductor and the other ends of said first and second lengths of microstrip conductor form the input and output terminals of the microstrip resonance isolator; and a thin rectangular substrate of hexagonal grain-oriented ferrite material mounted on one of said sides of said dielectric waveguide element and extending along a portion of the length of said waveguide element top surface central section, said ferrite material having a unidirectional magnetic orientation in a direction which is parallel to the plane of said one side of said waveguide element and substantially perpendicular to the plane of said microstrip dielectric substrate top surface and which provides low loss transmission of electromagnetic wave energy traveling from the input terminal of the isolator to the output terminal thereof and high attenuation of said energy traveling from the output terminal of the isolator to the input terminal thereof.

2. A microstrip resonance isolator as claimed in claim 1 wherein each of said first, second and third lengths of microstrip conductor comprises a section of a single integral length of microstrip conductor.

3. A microstrip resonance isolator as claimed in claim 1 wherein each of said first, second and third lengths of microstrip conductor comprises a separate length of microstrip conductor and said three separate lengths of microstrip conductor are electrically connected together at the ends of said gap by electrical connection means.

4. A microstrip resonance isolator as claimed in claim 1 wherein the height of said ferrite substrate is substantially the same as the height of said dielectric waveguide element top surface central section above said microstrip dielectric substrate top surface.

5. A microstrip resonance isolator as claimed in claim 1 further comprising a longitudinally-extending and longitudinally spaced-apart series of said ferrite substrates mounted on said one side of said dielectric waveguide element, each of said ferrite substrates functioning over different but contiguous frequency bands to thereby provide a broadband isolator.

* * * * *